US006820672B1

(12) United States Patent
Smits

(10) Patent No.: US 6,820,672 B1
(45) Date of Patent: Nov. 23, 2004

(54) DEVICE AND A METHOD FOR AFFIXING OBJECTS TO PRODUCTS

(76) Inventor: Antonius Adrianus Arnoldus Smits, Rhijnestein 106, NL-1121 VH Landsmeer (NL)

( * ) Notice: Subject to any disclaimer, the term of this patent is extended or adjusted under 35 U.S.C. 154(b) by 0 days.

(21) Appl. No.: 09/555,548

(22) PCT Filed: Dec. 1, 1998

(86) PCT No.: PCT/NL98/00678

§ 371 (c)(1),
(2), (4) Date: Aug. 1, 2000

(87) PCT Pub. No.: WO99/28194

PCT Pub. Date: Jun. 10, 1999

(30) Foreign Application Priority Data

Dec. 3, 1997 (NL) ..... 1007683

(51) Int. Cl.[7] ..... B65H 29/24

(52) U.S. Cl. ..... 156/556; 156/566; 156/567; 156/568; 156/571; 156/DIG. 37; 271/91; 271/103; 271/106

(58) Field of Search ..... 271/91, 95, 98–99, 271/102–103, 106; 156/215, 230, 285, 521, 542, 555, 566, 567, 568, DIG. 2–4, DIG. 6–13, DIG. 17–18, DIG. 37, 569, 570, 571, 235, 556, 539, 540, 541; 53/225, 234

(56) References Cited

U.S. PATENT DOCUMENTS

| | | | | | |
|---|---|---|---|---|---|
| 2,887,022 | A | * | 5/1959 | Lubersky et al. | 493/124 |
| 4,025,385 | A | * | 5/1977 | Wood | 156/568 |
| 4,238,267 | A | * | 12/1980 | Konstantin | 156/379.6 |
| 4,293,365 | A | * | 10/1981 | Geyser et al. | 156/364 |
| 4,302,277 | A | * | 11/1981 | Ilsemann | 156/567 |
| 4,605,459 | A | | 8/1986 | Voltmer et al. | 156/215 |
| 4,767,487 | A | * | 8/1988 | Tomsovic, Jr. | 156/256 |
| 4,962,634 | A | * | 10/1990 | Boldrini et al. | 53/207 |
| 5,102,485 | A | * | 4/1992 | Keeler et al. | 156/256 |
| 5,104,369 | A | * | 4/1992 | Calvert | 493/315 |
| 5,241,743 | A | | 9/1993 | Hubbs et al. | 29/775 |
| 5,256,365 | A | * | 10/1993 | Gordon et al. | 264/509 |
| 5,290,391 | A | | 3/1994 | Czech et al. | 156/566 |
| 5,431,274 | A | * | 7/1995 | Schaupp | 198/474.1 |
| 5,489,360 | A | * | 2/1996 | Shimizu et al. | 156/542 |

FOREIGN PATENT DOCUMENTS

| | | | |
|---|---|---|---|
| AU | 541100 B | 12/1984 | B65B/61/18 |
| EP | 0035645 | 9/1981 | B65B/15/00 |
| EP | 0085895 | 8/1983 | B65B/61/20 |
| GB | 2188608 | 10/1987 | B65C/9/42 |

* cited by examiner

*Primary Examiner*—Blaine Copenheaver
*Assistant Examiner*—Jessica Rossi
(74) *Attorney, Agent, or Firm*—Webb Ziesenheim Logsdon Orkin & Hanson, P.C.

(57) ABSTRACT

A device for affixing objects to products moving in a row, which device includes a holder for a stock of the objects and with an affixing device that includes a carrier for removing an object from the holder and moving the object. The affixing device is capable of rotary movement about an axis of rotation. The object is affixed to the moving product during the rotary movement of the affixing device. The affixing device can be driven intermittently between rotation and standstill. During the standstill of the affixing device, the carrier can remove the object from the holder. Preferably, more than one carrier is provided, with the carriers each provided with a suction nozzle.

14 Claims, 2 Drawing Sheets

DEVICE AND A METHOD FOR AFFIXING OBJECTS TO PRODUCTS

BACKGROUND OF THE INVENTION

The invention relates to a device for affixing objects to products moving in a row, which device is provided with a holder for a stock of said objects and with affixing means comprising a carrier for removing an object from said holder and moving said object, and which affixing means are capable of rotary movement about an axis of rotation and of affixing said object to the moving product during said rotary movement.

A device of this kind can for example be used for placing objects, such as product samples, in a magazine. For example, bags of shampoo or bags of soup can be glued to a particular page of a magazine. This can be done when quires of said magazines are joined on a binding machine, whereby said quires move along in a row.

The device may also be used for affixing address labels or other appendices to parcels, for example, before said parcels are enveloped in transparent plastic material.

The device may for example also be used for providing flat sheets, from which a packaging box is to be formed, with stiffening parts which are glued to said flat sheet to form a stiffening element in the box when it is folded at a later stage.

With such a device, it is important that the occurrence of malfunctions is reduced to a minimum, because the affixation of objects by means of such a device forms part of a comprehensive, continuous process, which process can be stopped entirely by a malfunction. Generally, such a device is only suitable for affixing one particular type of object.

The objective of the invention is to provide a device for affixing objects to products moving in a row, wherein different kinds of objects, in particular objects having a three-dimensional shape of other objects which are difficult to handle, can be affixed at a high rate in a reliable manner.

SUMMARY OF THE INVENTION

To this end, the affixing means can be driven intermittently, with rotation and standstill alternating with each other, during which standstill the carrier can remove an object from the holder. The temporary standstill of the affixing means enables the carrier to remove an object from the holler in a reliable manner, whilst the rotary movement of the affixing means causes the carrier to move in a circular arc, which is a suitable movement for affixing the objects being taken to products moving in a rectilinear path.

Preferably, the affixing means are provided with more than one carrier, three carriers in a preferred embodiment, wherein the carriers are positioned a substantially uniform distance apart in a circle round the axis of rotation, in such a manner that one carrier is positioned near the holder during standstill of the affixing means, whilst the place where the objects are to be affixed to the products is located at a position on said circle, substantially centrally between two carriers. When three carriers are provided, the carrier which is positioned straight above the affixing means during standstill of the driving means can pull objects from a holder at the underside thereof, whilst a carrier which moves in a circular path, during which movement it can affix an object to a moving product, will be present at the underside of the affixing means during the rotation of the driving means that is carried out in order to place the next carrier in the upper position. It is also possible to place the holder in a position other than straight above the affixing means.

Preferably, a carrier is provided with a suction nozzle, preferably two suction nozzles, for engaging an object. Since the affixing means are at a standstill while said engaging takes place, a sub-atmospheric pressure can be generated in said suction nozzle whilst the object abuts against the nozzle at rest. As soon as a desired sub-atmospheric pressure is available, the object can be pulled from the holder and the affixing means can start to rotate. By making the diameter of the suction nozzle sufficiently large, preferably more than 15 mm, a relatively large engaging force can be effected in a relatively short period. The use of two suction nozzles positioned next to one another makes it possible to effect a very stable engagement.

Preferably, the carrier is movable in a radial direction with respect to the axis of rotation, so that the carrier can move during standstill of the affixing means, to a position in which it abuts against an object which is present in the holder, from which position it can pull said object from the holder when the carrier moves in a reverse direction.

In one preferred embodiment, the affixing means are provided with more than one carrier, wherein said carriers are positioned a substantially uniform distance apart in a circle round the axis of rotation, wherein the holder on the one hand and the place where the objects are affixed to the products on the other hand are positioned in such a manner with respect to each other, that one carrier will be present at the location of the holder during standstill of the affixing means, and another carrier, which has removed an object from the holder, will not have affixed said object yet.

Furthermore, a glue dispenser may be present, which is capable of applying an amount of glue to the object which has been engaged by a carrier. The object can then be glued to the product. Especially if the glue is to be applied in a specific manner, for example in order to glue the object to the product in a specific manner, it will be advantageous to apply the glue during standstill of the carrier with the object, which can take place whilst another carrier is engaging an object.

During standstill of the affixing means, an object which has been engaged by a carrier can furthermore be provided with a text, a number or other mark or code, for example by means of an inkjet printer. The encoding of objects in this manner may be considered to constitute an invention by itself.

Preferably, the device is provided with its own electric up; driving motor, and it is preferred not to have the device driven by the same driving means that move the products.

This makes it possible to use the device in a flexible manner, in particular with regard to the location at which the device is installed. Preferably, the rotational speed of the driving motor is controlled on the basis of signals from a pulse generator, which signals are a measure for the speed of movement of the products. Such a pulse generator can be mounted near a rotary shaft of the driving means that move the products, wherein the pulse generator delivers signals which are a measure for the rotational speed of the shaft in question. The rotational speed of the driving motor can be adapted to the speed of movement of the products as desired via electronic control of the driving motor. Thus it is ensured that the rotation of the affixing means and the movement of the products take place in a synchronized manner.

In one preferred embodiment, control means are present, which are capable of putting a carrier temporarily out of action, so that said carrier will not engage an object from the holder during standstill at the holder. This makes it possible to select whether or not to affix an object to a product, for example when a product is missing in the row of moving products, without interfering with the movement of the affixing means.

In another embodiment, control means are present, which control means are provided with detection means, which detect that a moving product is approaching the affixing means. The rotation of the affixing means can be controlled in such a manner that a rotation is started when a product is approaching, whilst the approach of a next product is awaited during standstill.

By using the device it becomes possible to control and/or adjust the speed of motion of the object during rotation on the one hand and the time span between two successive affixing moments of an object on the other hand independently of each other.

In one preferred embodiment, the affixing means are driven via an index mechanism, whose outgoing shaft is intermittently stationary, whilst the ingoing shaft rotates continuously. Such an index mechanism, which is known per se, is commercially available. Preferably, the ingoing shaft of the index mechanism also drives a driving mechanism for driving parts of the device, for example the carrier, during standstill of the affixing means, so that the carrier can move during standstill off said outgoing shaft. Thus, the movement of the carrier can take place at precisely the right moment during standstill of the affixing means.

To that end, the ingoing shaft of the index mechanism is preferably provided with a cam disc, against which a cam abuts, which cam is provided on a driving mechanism for driving parts of the carrier during standstill of the affixing means. The cam may be provided on a lever which is rotatable about a shaft, whereby rotation of said shaft causes the carrier to move.

Preferably, said driving mechanism comprises a lever which is rotatable about a shaft, which lever is provided with a cam, whose movement causes the carrier to move.

The invention furthermore relates to a method for affixing objects to products moving in a row, whereby an object is removed by affixing means from a holder of a stock of objects and subsequently moved by said affixing means to a position in which it abuts against a moving product, whilst the affixing means are rotated about an axis of rotation, at such a speed that the speed of movement of the object is substantially equal to the speed of movement of the product, wherein the affixing means are driven intermittently, with rotation and standstill alternating with each other, during which standstill the affixing means remove an object from the holder. The speed at which said affixation takes place is higher than 5,000 objects per hour thereby, preferably higher than 10,000 objects per hour.

The affixing means can thereby be driven via an index mechanism, the outgoing shaft of which is intermittently stationary, whilst the ingoing shaft rotates continuously, wherein said ingoing shaft can also drive a driving mechanism, which drives parts of the device, for example the carrier, during standstill of the affixing means.

In order to provide a better understanding of the invention, an embodiment of a device for affixing objects to moving products will be described hereafter with reference to the drawings.

The figures are merely diagrammatic representations, wherein certain parts have been left out in each figure so as to show other parts more clearly.

DETAILED DESCRIPTION OF THE PREFERRED EMBODIMENTS

Figure 1:
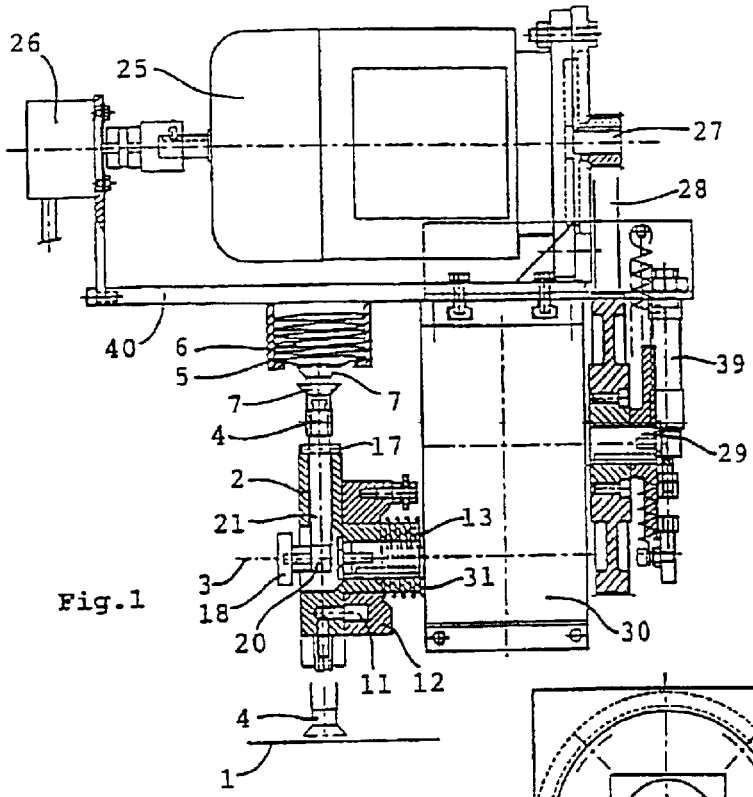
FIG. 1 is a side view of the device.

FIG. 1 is a side view of the machine, that is, the machine is shown in the direction of movement of the row of products. The path in which the products move lies near line 1. Present above said path 1 are affixing means 2, which rotate about axis of rotation 3. Inc means 2 are provided with three carriers 4, which are positioned relative to each other as shown in FIG. 2.

Present above the affixing means 2 is a holder 5, in which a stack of objects 6 is present, for example a stack of bags of shampoo. Said holder 5 is only shown in FIG. 1. FIG. 1 furthermore shows a radial, upward movement of carrier 4, which makes it possible to move nozzle 7 in abutment with the lowermost object 6 in holder 5. When suction nozzle 7 abuts against the lowermost object 6, a sub-atmospheric pressure can be generated in said suction nozzle, as a result of which the lowermost object 6 can be pulled from holder 5 when carrier 4 moves downwards to its starting position.

Figure 2:
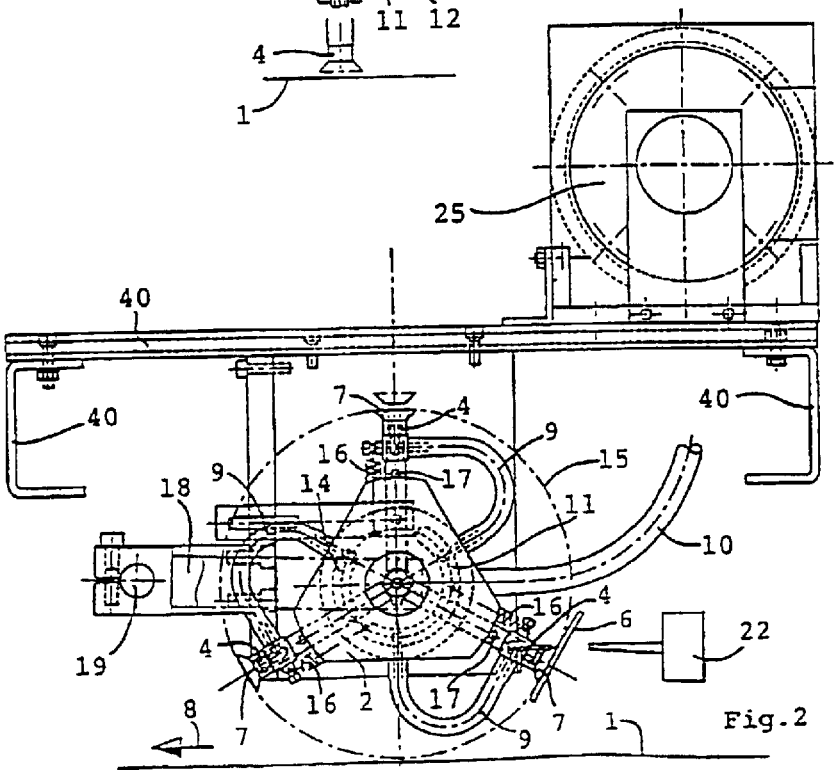
FIG. 2 is a front view of the devices.

FIG. 2 shows how the affixing means 2 can rotate through an angle of 120° in order to move the next carrier 4 to the upper position, from where said next carrier 4 can take along an object 6 from holder 5. Then the affixing means are rotated further through 120°, whereby the object 6 that was taken along first is affixed to a product moving in path 1 in the direction indicated by arrow 8. The sub-atmospheric pressure is thereby released the moment carrier 4 occupies the lower position.

It will be apparent, that the affixing means 2 rotates through an angle of 120° each time, whereby an object 6 can be affixed to a passing product, whilst affixing means 2 will be stationary for some time after each rotation, wherein a carrier 4 occupies the upper position, engaging an object 6 from the holder 5 thereby.

Figure 4:
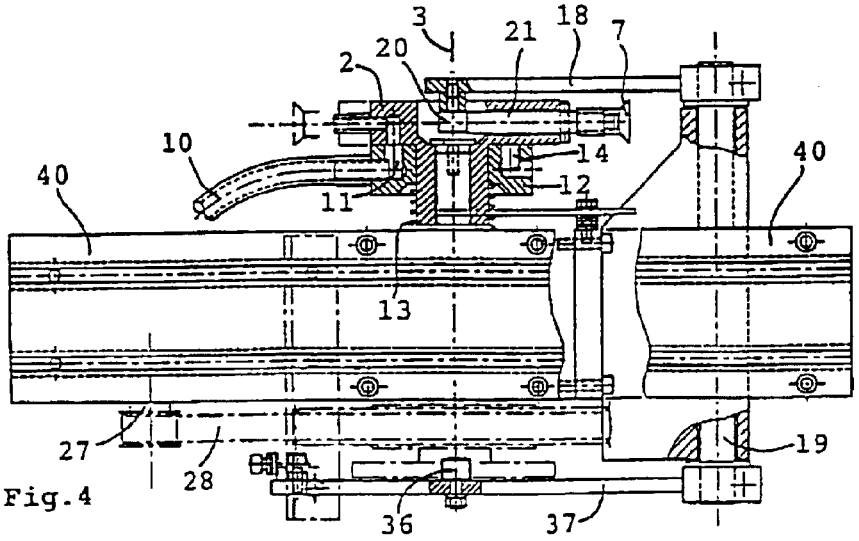
FIG. 4 is a plan view of the device.

Each carrier 4 is provided with an air hose 9, through which air can be sucked out of nozzle 7 or be supplied to said nozzle 7. To that end, a discharge hose 10 is provided, through which air is sucked out. Discharge hose 10 is in communication with chamber 11, which extends along a circular arc in a stationary housing 12, which is pressed against rotatable affixing means 2 by means of coil spring 13. During rotation, the air hoses 9 are temporarily in communication with chamber 11, and that from the moment the respective carrier 4 occupies the upper position until the moment said carrier 4 occupies the lower position. When carrier 4 passes said lower position, the hose 9 of the carrier 4 in question comes into contact with chamber 14, in which an atmospheric pressure prevails. Also chamber 14 is provided in housing 12, it extends along a circular arc. Chambers 11 and 14 are illustrated in dashed lines in FIG. 2, the sectional view of FIG. 1 shows chamber 1 and the sectional view of FIG. 4 shows chamber 11 as well as chamber 14, whereby said figure also shows chamber 14 to be in communication with the atmosphere.

The circular path on which nozzles 7 are located during rotation of affixing means 2 is illustrated in a chain-dotted line 15 in FIG. 2.

Each carrier 4 is provided with a coil spring 16, which retains the carrier in question in its starting position, whereby stop 17 abuts against affixing means 2. Carrier 4 can be moved upwards when occupying its upper position, so that nozzle 7 is placed in abutment with an object 6 in holder 5. Said upward movement is driven by lever 18, which is mounted on shaft 19, whereby a cam 20 of said lever, or lever cam, abuts against part 21 of carrier 4. Rotation of shaft 19 causes lever 18 to move upwards, and carrier 4 moves upwards correspondingly, so that suction nozzle 7 can engage an object 6 from holder 5.

FIG. 2 shows a glue dispenser 22, by means of which a predetermined amount of glue can be sprayed onto object 6 in order to cause object 6 to adhere to the product which is moving along in path 1. The glue is applied to the object during standstill of the affixing means 2. Instead of a glue dispenser, an inkjet printer may be provided, by means of which a code can be placed on the object.

The device is driven by means of a driving motor 25, whose speed is controlled by means of a speed controller 26 on the basis of signals which indicate the speed of movement of the products in path 1. To that end, speed controller 26 can be connected to a pulse generator (not shown), which is mounted on the driving means of the moving objects.

Figure 3:
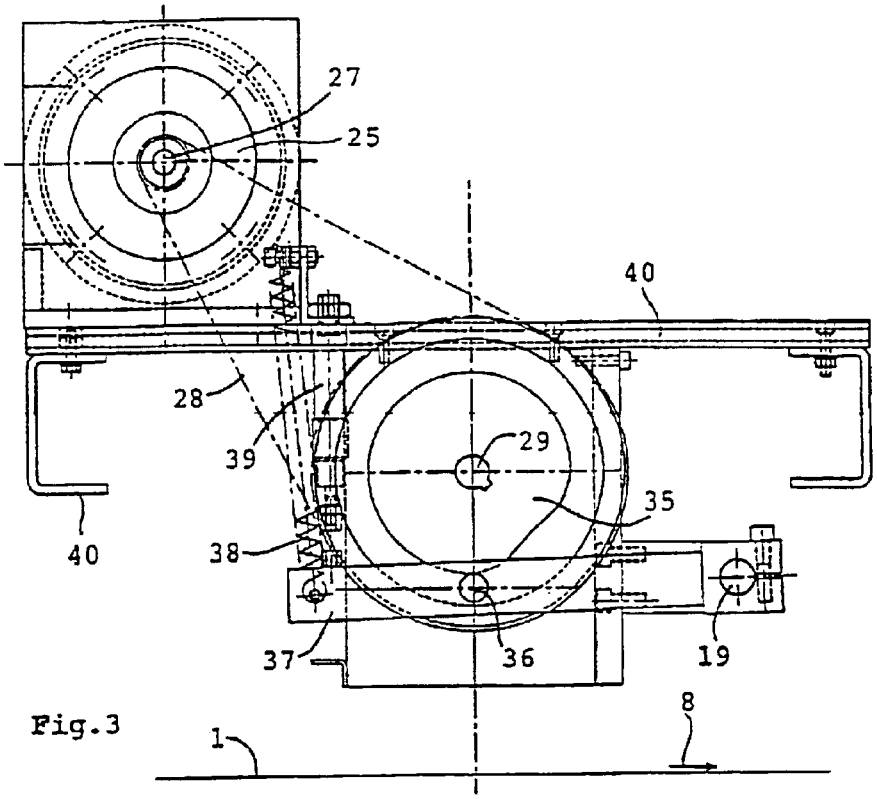
FIG. 3 is a rear view of the device.

As is shown in FIG. 3, outgoing shaft 27 of driving motor 25 is drivably connected to the ingoing shaft 29 of an index mechanism 30 (FIG. 1) by means of a toothed belt transmission 28. Index mechanism 30 comprises an ingoing shaft 29 and an outgoing shaft 31, on which outgoing shaft the driving means 2 are mounted.

The index mechanism which is used in this embodiment is a commercially available product. When ingoing shaft 29 of index mechanism 30 makes one revolution at a substantially constant speed, outgoing shaft 31 will rotate through an angle of 120°, whereby shaft 31 will be stationary for some time and carry out said rotation for some time. The position which is shown in FIGS. 1 and 2 is the position in which affixing means 2 is stationary.

Ingoing shaft 29 is furthermore provided with a cam disc 35, against which cam 36 abuts (FIG. 3). Cam 36 is provided on lever 37, which is attached to shaft 19 and which is pressed against cam disc 35 by means of draw spring 38. Lever 37 is moved upwards with every revolution of ingoing shaft 29, and since lever 37 is connected, via shaft 19, to lever 18 (FIG. 2), a carrier 4 is moved upwards by means of cam 20. The control is thereby such that said movement takes place while affixing means 2 are stationary.

In addition, a control element 39 is present, which holds lever 37 in its lowermost position, if desired, so that cam 36 will not follow the surface of the cam disc 35, and carrier 4 will not make an upward movement. Control element 30 is excited when a carrier must not take an object from holder 5, it is preferably pneumatically driven.

The device is furthermore provided with a frame 40, which is preferably mounted on a movable support which is disposed on the floor, in which support frame 40 can be fixed in such a manner that the device will be positioned at a desired location. As a result of that, no additional means are required for attaching the device to another device, and the device can easily be used at varying locations.

The illustrated embodiment of the device is only an example, which is given by way of illustration, several other embodiments of the device are possible. The scope of the present invention is defined in the appended claims and equivalents thereto.

What is claimed is:

1. A device for affixing objects to products moving in a row, the device comprising a holder for a stock of the objects and affixing means further comprising at least one suction nozzle on a carrier for removing one of the objects from the holder and moving the object, wherein the affixing means is capable of rotary movement about an axis of rotation wherein the affixing means is further capable of being driven intermittently between rotation and standstill, wherein during standstill of the affixing means the carrier is positioned in alignment with an object in a holder and is moveable in a radial direction with respect to the axis of rotation for attaching the at least one suction nozzle to the object and for removing the object from the holder, wherein the at least one suction nozzle of the carrier directly faces the object within the holder and wherein the device further comprises means for moving said products along a path, said path extending such that if tangentially approaches the rotational path of the affixing means at a position substantially centrally between the position of two carriers during standstill, such that the affixing means is capable of affixing the object to a moving product during rotary movement of the affixing means, and means for synchronizing the movement of the affixing means and the products, such that during rotary movement of the affixing means the speed of movement of the object is substantially equal to the speed of movement of the product.

2. The device according to claim 1, wherein the affixing means includes more than one carrier, wherein the carriers are positioned a substantially uniform distance apart in a circle around the axis of rotation and in such a manner that one of the carriers is positioned near the holder during the standstill of the affixing means while a place where the objects are to be affixed to the products is located at a position on the circle located substantially centrally between two of the carriers.

3. The device according to claim 1, wherein the suction nozzle has a diameter of more than 15 mm.

4. The device according to claim 1, wherein the affixing means includes more than one carrier, wherein the carriers are positioned a substantially uniform distance apart in a circle around the axis of rotation, wherein the holder and a place where the objects are affixed to the products are positioned in such a manner with respect to each other that one of the carriers will be present at the location of the holder during the standstill of the affixing means while another of the carriers which has removed one of the objects from the holder will not yet have affixed the object.

5. The device according to claim 1, wherein the device further includes an electric driving motor whose rotational speed is controlled on a basis of signals from a pulse generator, and wherein the signals are a measure of speed of movement of the products.

6. The device according to claim 1, further including control means capable of putting the carrier temporarily out of action.

7. The device according to claim 1, further including control means which is provided with detection means which detects that a moving product is approaching the affixing means.

8. The device according to claim 1, further including a glue dispenser capable of applying an amount of glue to the object engaged by the carrier.

9. The device according to claim 8, wherein the glue dispenser applies the amount of glue to the object engaged by the carrier during the standstill of the affixing means.

10. The device according to claim 1, wherein the affixing means is driven via an index mechanism having an outgoing shaft that is intermittently stationary and an ingoing shaft that rotates continuously.

11. The device according to claim 10, wherein the ingoing shaft of the index mechanism further drives a driving mechanism for driving the carrier during the standstill of the affixing means.

12. The device according to claim 10, wherein the ingoing shaft of the index mechanism includes a cam disc against which a cam abuts, and wherein the cam is provided on a driving mechanism for driving the carrier during the standstill of the affixing means.

13. The device according to claim 12, wherein the cam is provided on a lever which is rotatable about a shaft such that rotation of the shaft causes the carrier to move.

14. The device according to claim 13, wherein the driving mechanism comprises a lever rotatable about a shaft, wherein the lever is provided with a lever cam, and wherein movement of the lever cam causes the carrier to move.

* * * * *

UNITED STATES PATENT AND TRADEMARK OFFICE

CERTIFICATE OF CORRECTION

PATENT NO. : 6,820,672 B1
DATED : November 23, 2004
INVENTOR(S) : Smits

It is certified that error appears in the above-identified patent and that said Letters Patent is hereby corrected as shown below:

Column 6,
Line 17, "if tangentially approaches" should read -- it tangentially approaches --

Signed and Sealed this

Twenty-fourth Day of May, 2005

JON W. DUDAS
*Director of the United States Patent and Trademark Office*